United States Patent [19]

Yoneda et al.

[11] Patent Number: 4,506,833

[45] Date of Patent: Mar. 26, 1985

[54] FUEL INJECTION NOZZLE FOR AN INTERNAL COMBUSTION ENGINE

[75] Inventors: Kenji Yoneda, Atsugi; Kunihiko Sugihara, Tokyo; Shoji Ushimura, Yokosuka, all of Japan

[73] Assignee: Nissan Motor Company, Limited, Japan

[21] Appl. No.: 428,222

[22] Filed: Sep. 29, 1982

[30] Foreign Application Priority Data

Nov. 9, 1981 [JP] Japan ..... 56-179242

[51] Int. Cl.[3] ..... F02M 45/08

[52] U.S. Cl. ..... 239/533.4

[58] Field of Search ..... 239/533.2, 533.3, 533.4, 239/533.5, 533.6, 533.7, 533.8, 533.9, 533.11, 533.12

[56] References Cited

U.S. PATENT DOCUMENTS

| | | | |
|---|---|---|---|
| 3,469,793 | 9/1969 | Guertler | 239/533.5 |
| 4,162,043 | 7/1979 | Eblen et al. | 239/533.3 |

FOREIGN PATENT DOCUMENTS

| | | | |
|---|---|---|---|
| 663301 | 8/1938 | Fed. Rep. of Germany . | |
| 1046950 | 12/1958 | Fed. Rep. of Germany . | |
| 2803774 | 8/1979 | Fed. Rep. of Germany . | |
| 1197303 | 11/1959 | France | 239/533.12 |
| 0593244 | 5/1959 | Italy | 239/533.3 |
| 6610924 | 2/1967 | Netherlands | 239/533.3 |

OTHER PUBLICATIONS

Motortechnische Zeitschrift 41, (1980), 7/8.

*Primary Examiner*—Jeffrey V. Nase
*Assistant Examiner*—Michael J. Forman
*Attorney, Agent, or Firm*—Lowe, King, Price & Becker

[57] ABSTRACT

A fuel injection nozzle for an internal combustion engine includes a hollow nozzle body and a valve member liftably disposed therein. The nozzle body and the valve member define a space therebetween through which fuel is supplied to an orifice in the nozzle body. The valve member contacts the nozzle body at a position to block communication between the space and the orifice when the valve member is in the unlifted position. Fuel enters the orifice from the space as the valve member lifts. The valve member and nozzle body have opposing surfaces establishing a gap between the space and orifice. The gap has a cross-sectional area smaller than that of the orifice that remains constant as the valve member lifts through a predetermined range so that the rate of fuel injection increases through a plateau as the valve member lifts to a position above the predetermined range.

3 Claims, 4 Drawing Figures

FUEL INJECTION NOZZLE FOR AN INTERNAL COMBUSTION ENGINE

BACKGROUND OF THE INVENTION

This invention relates to a fuel injection nozzle for an internal combustion engine, such as a diesel engine. More particularly, it relates to a fuel injection nozzle including a hollow nozzle body and a valve member liftably disposed in the nozzle body to selectively block communication between a fuel passage and the internal openings of injection orifices in the nozzle body.

Some conventional fuel injection nozzles for diesel engines include hollow nozzle bodies and valve members liftably disposed in the nozzle bodies to selectively close the internal openings of injection orifices in the nozzle bodies. In such a fuel injection nozzle, the effective cross-sectional area of the fuel supply path including the injection orifices abruptly increases to its maximum as the valve member lifts. Therefore, during the initial stage of fuel injection, a relatively great amount of fuel is injected into a combustion chamber of the engine. However, it is desirable to reduce somewhat the amount of fuel injected during this stage from the standpoint of reducing combustion shocks, vibrations or sounds, and of reducing engine emissions of harmful NOx (oxides of nitrogen).

SUMMARY OF THE INVENTION

It is an object of this invention to provide a fuel injection nozzle for an internal combustion engine which supplies a relatively small amount of fuel to a combustion chamber of the engine during the initial stage of fuel injection in order to reduce combustion shocks and emissions of harmful NOx.

In accordance with this invention, a fuel injection nozzle for an internal combustion engine includes a hollow nozzle body and a valve member liftably disposed in the nozzle body. The nozzle body has an orifice extending from the inside to the outside thereof. The nozzle body and the valve member establish therebetween a space in which fuel is supplied. The valve member contacts the nozzle body at a position between the space and the orifice so as to block communication between the space and the orifice when the valve member is in the unlifted position. The valve member separates from the nozzle body to establish the communication as the valve member lifts. Fuel is then enter the orifice from the space when the valve member lifts but cannot enter the orifice when the valve member is in the unlifted position. The valve member and nozzle body each have a surface extending in the direction of lift. The nozzle body surface is inside the nozzle body downstream from the space but upstream from the orifice. The surfaces define a gap whose cross-sectional area is smaller than that of the orifice and remains constant as the valve member lifts through a predetermined range so that the rate of fuel injection increases through a plateau as the valve member lifts from the unlifted position to a position above the predetermined range.

The above and other objects, features and advantages of this invention will be apparent from the following description of preferred embodiments thereof, taken in conjunction with the drawings.

DESCRIPTION OF THE PREFERRED EMBODIMENT

Figure 1:
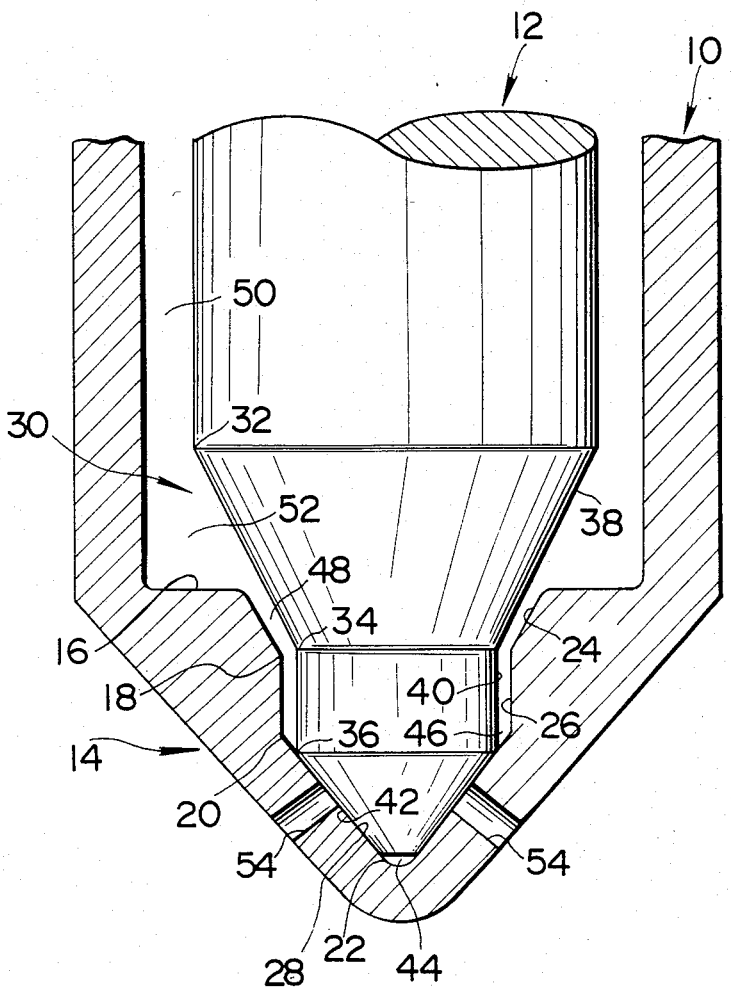
FIG. 1 is a longitudinal section view of a fuel injection nozzle according to a first embodiment of this invention.
Figure 2:
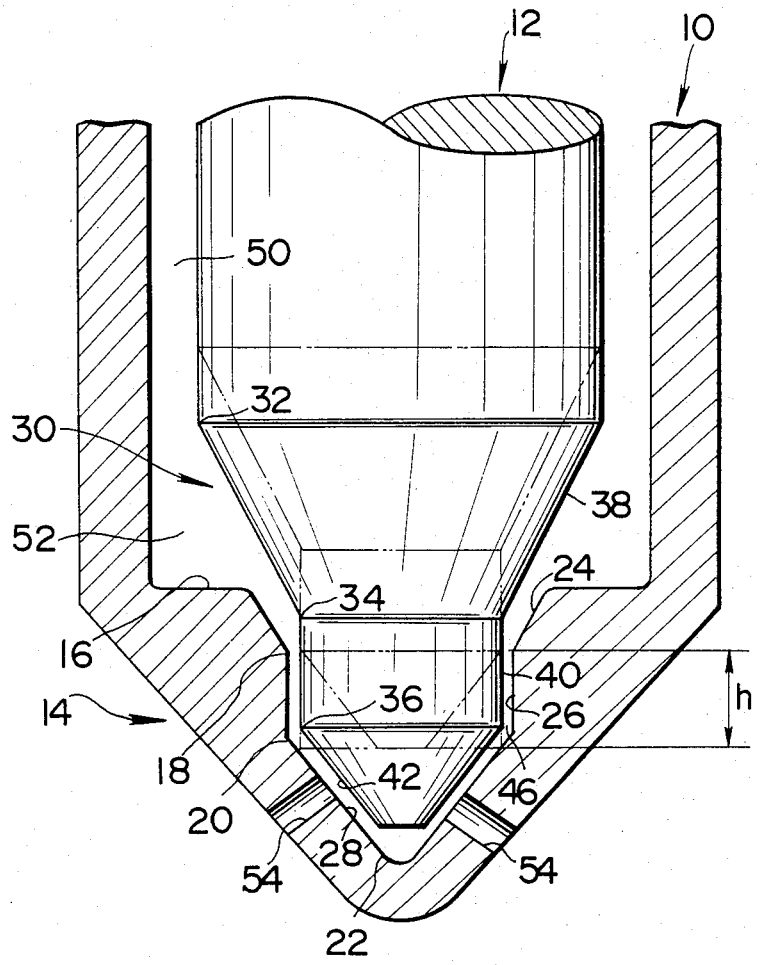
FIG. 2 is a view similar to FIG. 1 and illustrates the valve member in a slightly lifted position in solid lines and in a further lifted position in broken lines.

With reference to FIGS. 1 and 2, there is shown a fuel injection nozzle for an internal combustion engine, such as a diesel engine, according to a first embodiment of this invention. The fuel injection nozzle includes a hollow cylindrical nozzle body 10 and a solid cylindrical valve member 12 coaxially disposed in the nozzle body 10. the valve member 12 can move axially relative to the nozzle body 10 in a well-known manner.

The nozzle body 10 has a hollow conical lower end 14. The inside diameter of the nozzle body end 14 decreases stepwise, from a first position 16 proximate the top thereof, at a first fixed slope to a second position 18 in the axial direction toward the bottom thereof. The inside diameter of the nozzle body end 14 is constant from position 18 to a third position 20, and then decreases at a second fixed slope from the position 20 to a fourth position 22 in close vicinity to the bottom. The interior of nozzle body end 14 thus has an annular shoulder or step 16 near the top thereof, a first frustum or frusto-conical surface 24 contiguously below step 16, a cylindrical surface 26 contiguously below the frustum surface 24, and a second frustum or frusto-conical surface 28 contiguously below the cylindrical surface 26. The lower interior end of nozzle body end 14 is concave.

The valve member 12 has a roughly cone-shaped lower end 30. The outside diameter of the valve member end 30 decreases at a first preset slope from a first position 32 near the top thereof to a second position 34, is constant from the position 34 to a third position 36, and decreases at a second preset slope from the position 36 to the bottom thereof. The bottom of the valve member end 30 is flat and perpendicular to the axis of the valve member 12. Valve member end 30 thus has a first frustum or frusto-conical surface 38, a cylindrical surface 40 contiguously below the frustum surface 38, and a second frustum or frusto-conical surface 42 contiguously below the cylindrical surface 40.

The slope of nozzle body frustum surface 28 is equal to the slope of valve member frustum surface 42, so that surfaces 28, 42 are essentially flush or mate with one another. When the valve member 12 is in the lowermost normal or unlifted position, the frustum surfaces 28 and 42 are in contact with one another. As the valve member 12 lifts from the normal position, the frustum surfaces 28 and 42 separate. The bottoms of the valve member end 30 and the nozzle body end 14 define an enclosed space 44 when the valve member 12 is in the normal position.

The inside diameter of the nozzle body cylindrical surface 26 is greater than the outside diameter of the valve member cylindrical surface 40. When the valve member 12 is in the normal position, the cylindrical surfaces 26 and 40 oppose one another and define a cylindrical shell gap 46 therebetween. The slope at the nozzle body frustum surface 24 is equal to the slope at the valve member frustum surface 38. When the valve member 12 is in the normal position, approximately the lower half of the frustum surface 38 opposes the frustum surface 24 and defines a truncated-cone shell gap 48 therewith. The gaps 46 and 48 communicate with one another.

The inside diameter of the nozzle body 10 above end 14 is constant. The outside diameter of the valve member 12 above end 30 is also constant, and is smaller than the constant inside diameter of nozzle body 10. Thus nozzle body 10 and valve member 12 above the respective ends 14 and 30 define a space 50 of cylindrical shell cross-section. When the valve member 12 is in the normal position, approximately the upper half of valve member frustum surface 38 opposes step 16 and the lower part of the constant inside-diameter portion to establish an annular space 52 of predominantly triangular cross-section. Space 52 communicates with space 50 and gap 48.

The nozzle body end 14 has orifices 54 which extend radially and downwardly from the inside to the outside thereof. The inner ends or openings of the orifices 54 lie on the frustum surface 28. The inner ends of the orifices 54 are closed by the valve member frustum surface 42 when the valve member is in the normal position, and are opened when the valve member lifts from the normal position.

The valve member 12 extends upward and slideably passes through an axial guide hole (not shown) in the nozzle body 10. A return or nozzle helical-spring (not shown) urges the valve member 12 downward, so that the valve member 12 is normally in the lower-most position where the valve member frustum surface 42 abuts or rests on the nozzle body frustum surface 28 and closes the inner ends of the orifices 54. The nozzle body 10 has a fuel passage (not shown) communicating with the space 50. This fuel passage is in turn connected to a fuel injection pump (not shown) to deliver fuel from the fuel injection pump to the space 50 and thus the space 52. Fuel enters the gaps 46 and 48 from the space 52. The guide hole and the fuel passage in the nozzle body 10, and the return spring are designed in a manner similar to a conventional fuel injection nozzle, such as disclosed in British Patent Specification No. 1,418,574, entitled Improvements in Fuel Injection for Internal Combustion Engines.

The fuel injection nozzle is mounted in the cylinder head of the engine in such a manner that the outer ends of the orifices 54 open to a combustion chamber of the engine.

In operation, the pressure of fuel in the space 52 and the gap 48 exerts an upward force on the valve member 12 via the frustum surface 38 thereof when the valve member 12 is in the normal position. When the pressure of fuel in the space 52 and the gap 48 exceeds a predetermined level, the valve member 12 lifts against the force of the return spring. The valve member frustum surface 42 separates from the nozzle body frustum surface 28 as the valve member 12 lifts, so that fuel enters the orifices 54 from the gap 46 via the resulting gap between the frustum surfaces 28 and 42 for injection into the combustion chamber. The cross-sectional area of the resulting gap between the frustum surfaces 28 and 42 is initially smaller than the total cross-sectional area of the orifices 54 and the cross-sectional areas of the gaps 46 and 48, and the spaces 50 and 52, so that the former gap determines the rate of fuel injection. Since the cross-sectional area of the resulting gap between the frustum surfaces 28 and 42 is essentially proportional to lift of the valve member 12, the rate of fuel injection initially increases in essential proportion to lift of the valve member 12 as shown in FIG. 3 by the line from the point O to the point A.

The cross-sectional area of the gap 46 is chosen to be smaller than the total cross-sectional area of the orifices 54 and the cross-sectional areas of the gap 48, and the spaces 50 and 52 when the valve member 12 is in the normal position. The cross-sectional areas of the gap 48 and the space 52 essentially increase with lift of the valve member 12. The cross-sectional areas of the gap 46 and the space 50 remain essentially constant regardless of lift of the valve member 12, at least at the beginning of the lift stroke thereof. The cross-sectional area of the gap 46 is chosen so as to become smaller than that of the resulting gap between the frustum surfaces 28 and 42 before the lower edge of the valve member cylindrical surface 40 rises to the upper edge of the nozzle body cylindrical surface 26. Thus, the initial increase in the rate of fuel injection continues until the valve member 12 rises to the point A of FIG. 3 where the cross-sectional area of the gap between the frustum surfaces 28 and 42 is equal to that of the gap 46.

Figure 3:
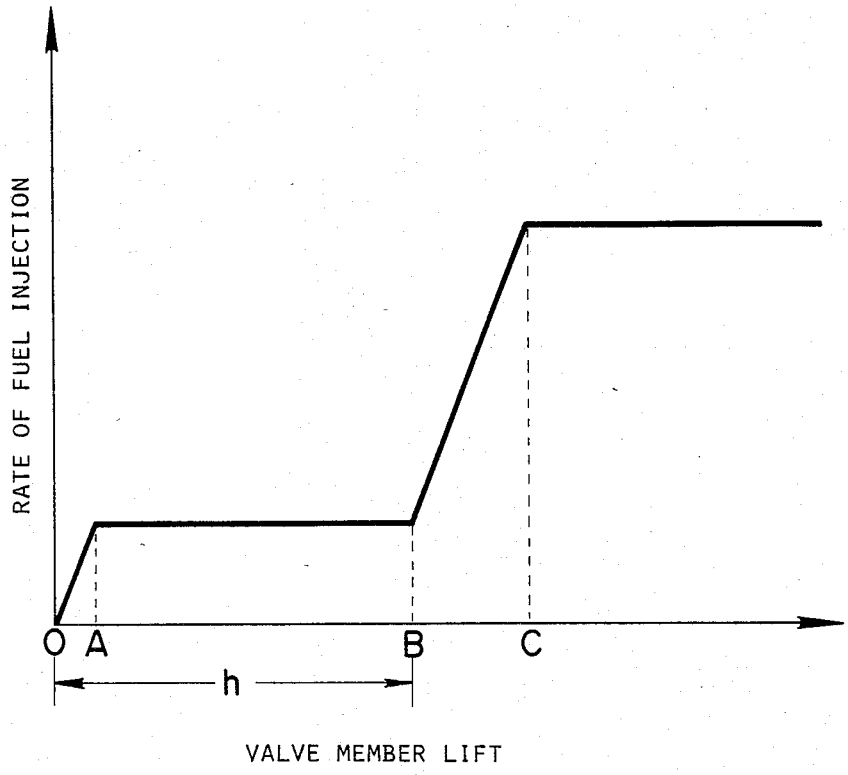
FIG. 3 is a graph of the approximate relationship between the rate of fuel injection via the fuel injection nozzle of FIG. 1 and lift of the valve member.

When the valve member 12 rises above the point A, the rate of fuel injection remains essentially constant as shown in FIG. 3 by the line from the point A to the point B. This is because the cross-sectional area of the gap 46 determines the rate of fuel injection and is essentially constant regardless of lift of the valve member 12. This constancy in the rate of fuel injection continues until the valve member 12 rises to the point B, as shown in the broken lines of FIG. 2, where the lower edge of the valve member cylindrical surface 40 aligns radially or horizontally with the upper edge of the nozzle body cylindrical surface 26. The lift of the valve member 12 to the point B is denoted by the common reference letter h in FIGS. 2 and 3.

As the valve member 12 rises above the point B, the cross-sectional area of the gap between the nozzle body end 14 and the valve member end 30 increases substantially linearly with lift of the valve member 12. In this case, the cross-sectional area of the gap between the ends 14 and 30 is initially smaller than the total cross-sectional area of the orifices 54 and so determines the rate of fuel injection. As shown in FIG. 3 by the line from the point B to the point C, the rate of fuel injection therefore increases linearly with lift of the valve member 12 when the valve member 12 rises above the point B. This increase in the rate of fuel injection continues until the valve member 12 rises to the point C where the cross-sectional area of the gap between the ends 14 and 30 is equal to the total cross-sectional area of orifices 54.

When the valve member 12 rises above the point C, the rate of fuel injection remains constant, since the total cross-sectional area of the orifices 54 determines the rate of fuel injection.

In this way, the injection rate of fuel increases through a plateau as the valve member 12 rises. Therefore, a relatively small amount of fuel is injected during the initial stage of fuel injection, causing a reduction in combustion shocks and in engine emissions of harmful NOx. Note that to achieve this increase profile in the rate of fuel injection, it is necessary to design the cross-sectional area of the gap 46 to be smaller than the total cross-sectional area of the orifices 54. The axial dimensions of the cylindrical surfaces 26 and 40, and the cross-sectional area of the gap 46 therebetween constitute parameters determining the amount of fuel injected during the initial stage of fuel injection. Specifically, the axial dimensions of the cylindrical surfaces 26 and 40 determine the lift range of constant fuel injection as shown in FIG. 3 by the line from the point A to the point B.

As the pressure of fuel in the gap between the nozzle body end 14 and the valve member end 30 drops, the valve member 12 is returned to the normal position by the force of the return spring, closing the inner ends of the orifices 54 and ending fuel injection. When the valve member 12 returns to the normal position, fuel trapped in the space 44 is prevented from leaking into the combustion chamber via the orifices 54, since the valve member 12 closes the inner ends of the orifices 54.

Figure 4:
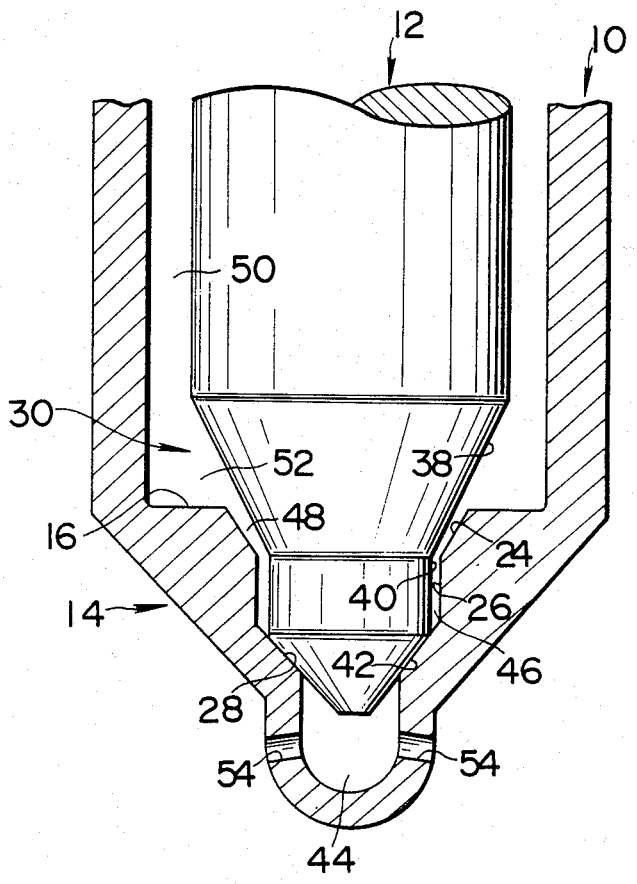
FIG. 4 is a longitudinal section view of a fuel injection nozzle according to a second embodiment of this invention.

A fuel injection nozzle of a second embodiment of this invention is shown in FIG. 4, in which reference characters matching those of FIGS. 1 and 2 denote parts matching those of FIGS. 1 and 2. This fuel injection nozzle is designed in a manner similar to that of the fuel injection nozzle of FIGS. 1 and 2 except for the following points:

The bottom of the nozzle body end 14 is in the form of a hollow hemisphere. When the valve member frustum surface 42 engages the nozzle body frustum surface 28, that is, when the valve member 12 is in the normal position, a hemispherical space 44 is defined by the bottoms of the nozzle body end 14 and the valve member end 30 while the lower edge of the valve member frustum surface 42 projects into the space 44. The inner ends of the orifices 54 open to the space 44.

Although the valve member 12 does not close the inner ends of the orifices 54, the engagement between the frustum surfaces 28 and 42 blocks communication between the inner ends of the orifices 54 and the gap 46 between the cylindrical surfaces 26 and 40 to interrupt or terminate fuel injection. As the valve member 12 rises from the normal position, the resulting gap between the frustum surfaces 28 and 42 establishes communication between the inner ends of the orifices 54 and the gap 46 to effect fuel injection. In this case, the rate of fuel injection increases through a plateau as the valve member rises, in a manner similar to that of the first embodiment.

It should be understood that further modifications and variations may be made in this invention without departing from the spirit and scope of this invention. For example, the valve member cylindrical surface 40 may slideably engage the nozzle body cylindrical surface 26. In this case, either of the surfaces 26 and 40 must have at least one axial groove with a constant cross-sectional area to establish communication between the orifices 54 and the gap 46 when the valve member 12 rises from the normal position.

What is claimed is:

1. A fuel injection nozzle for an internal combustion engine, comprising:

(a) a hollow nozzle body having an orifice extending from the inside to the outside thereof;

(b) a valve member liftably disposed in the nozzle body;

(c) the nozzle body and the valve member establishing, inside the nozzle body, a space to which fuel is supplied;

(d) the valve member contacting the nozzle body at a position between the space and the orifice so as to block communication therebetween when the valve member is in the unlifted position and to establish communication as the valve member lifts, whereby fuel to be injected enters the orifice from the space as the valve member lifts and is prevented from entering the orifice when the valve member is in the unlifted position;

(e) the valve member having a first surface extending in the direction of lift thereof, the nozzle body having a first surface extending in the direction of lift of the valve member, the nozzle body first surface being inside the nozzle body and being at a position downstream of the space but upstream of the orifice, the first surfaces defining a gap having a cross-sectional area that is smaller than that of the orifice and remains constant as the valve member lifts through a predetermined lift range so that (1) the rate of fuel injection initially increases up to a constant valve as the valve member rises from the unlifted position to a position within the predetermined lift range, (2) the injection rate remains at the constant value as said valve member continues to rise within the range, and (3) the injection rate increases above the constant value as the valve member lifts to a position above the predetermined lift range, wherein the magnitude of the cross sectional area of the gap determines the constant value;

(f) the nozzle body having a second surface extending obliquely with respect to the direction of lift of the valve member, the valve member having a second surface extending generally parallel to the nozzle body second surface, the second surfaces being arranged to contact and separate from one another as a function of lift of the valve member to selectively block and establish communication between the space and the orifice, the second surfaces being formed at positions downstream of the respective first surfaces;

(g) the inner end of the orifice being formed within the nozzle body second surface and being closed directly by the valve member second surface when the valve member is in the unlifted position.

2. A fuel injection nozzle as recited in claim 1, wherein the first surfaces are cylindrical and oppose each other when the valve member is in the unlifted position.

3. A fuel injection nozzle as recited in claim 1, wherein the second surfaces are frusto-conical.

* * * * *